US007878002B2

(12) United States Patent
Poyyapakkam

(10) Patent No.: US 7,878,002 B2
(45) Date of Patent: Feb. 1, 2011

(54) METHODS AND SYSTEMS TO FACILITATE REDUCING COMBUSTOR PRESSURE DROPS

(75) Inventor: Madhavan Narasimhan Poyyapakkam, Bangalore (IN)

(73) Assignee: General Electric Company, Schenectady, NY (US)

( * ) Notice: Subject to any disclaimer, the term of this patent is extended or adjusted under 35 U.S.C. 154(b) by 957 days.

(21) Appl. No.: 11/787,671

(22) Filed: Apr. 17, 2007

(65) Prior Publication Data

US 2008/0256956 A1 Oct. 23, 2008

(51) Int. Cl.
*F02C 1/00* (2006.01)
*F02G 3/00* (2006.01)

(52) U.S. Cl. ..... 60/752; 60/760

(58) Field of Classification Search ..... 60/752–760
See application file for complete search history.

(56) References Cited

U.S. PATENT DOCUMENTS

| | | | |
|---|---|---|---|
| 4,719,748 | A | 1/1988 | Davis, Jr. et al. |
| 6,250,062 | B1 | 6/2001 | Lawen, Jr. et al. |
| 6,405,536 | B1 | 6/2002 | Ho et al. |
| 6,442,929 | B1 | 9/2002 | Kraft et al. |
| 6,543,233 | B2 | 4/2003 | Young et al. |
| 6,725,667 | B2 | 4/2004 | Farmer et al. |
| 6,844,520 | B2 | 1/2005 | D'Andrea et al. |
| 6,851,263 | B2 | 2/2005 | Stumpf et al. |
| 6,892,543 | B2 | 5/2005 | Nakae |
| 7,010,921 | B2 | 3/2006 | Intile et al. |
| 7,082,770 | B2 * | 8/2006 | Martling et al. ..... 60/796 |
| 7,093,419 | B2 | 8/2006 | McCaffrey et al. |
| 7,571,611 | B2 * | 8/2009 | Johnson et al. ..... 60/772 |
| 2005/0144953 | A1 | 7/2005 | Martling et al. |
| 2005/0223713 | A1 | 10/2005 | Ziminsky et al. |

OTHER PUBLICATIONS

EPO Foreign Search Report related to Application No. 08154513.9-2301 dated Dec. 10, 2008.

* cited by examiner

*Primary Examiner*—Michael Cuff
*Assistant Examiner*—Craig Kim
(74) *Attorney, Agent, or Firm*—Armstrong Teasdale LLP

(57) ABSTRACT

A method for assembling a gas turbine combustor includes providing a combustor case having a first end, a second end, and a centerline extending there between, coupling an end cover to the case first end, coupling a combustor liner within the case such that the liner is substantially coaxially aligned with respect to the case, and providing a streamline flow conditioner including a body that includes a radially outer surface and a radially inner surface, a deflection plate that extends from the body, and coupling the streamline flow conditioner to the case second end such that the streamline flow conditioner is coupled radially between the case and the combustor liner such that the deflection plate is adjacent the case second end. The deflection plate inner surface at least one of extends radially outward with respect to the centerline and defines a plurality of openings within the plate inner surface.

20 Claims, 5 Drawing Sheets

METHODS AND SYSTEMS TO FACILITATE REDUCING COMBUSTOR PRESSURE DROPS

BACKGROUND OF THE INVENTION

This invention relates generally to combustors and more particularly, methods and systems to facilitate reducing pressure drops within gas turbine combustors and to facilitate increasing efficiency and lowering emissions and dampening thermo acoustic oscillations.

At least some known gas turbine engines include a multistage compressor that compresses inlet air to higher pressures and temperatures. The compressed air is channeled to combustors which mix the compressed air and fuel to generate combustion gases directed towards a turbine. The turbine drives the compressor and/or other loads such as, but not limited to, electric generators and mechanical drive applications. Known combustors are generally formed with an outer case and a combustion liner coupled radially inward from the case.

At least some known combustors also include a second liner, commonly referred to as a flow sleeve, which extends within the casing and around the combustion liner. Known flow sleeves include an inlet end that receives a portion of the compressed air channeled along a radially outer surface of the combustion liner. Although such a flow sleeve is generally used to increase cooling of the combustion liner, known flow sleeve configurations may also undesirably increase the pressure drop of air flowing through the flow sleeve.

BRIEF DESCRIPTION OF THE INVENTION

A method for assembling a gas turbine combustor for use with a turbine is provided. The method includes providing a combustor case having a first end, a second end, and a centerline extending there between. The method also includes coupling an end cover to the case first end and coupling a combustor liner within the case such that the liner is substantially coaxially aligned with respect to the case. The method also includes providing a streamline flow conditioner including a body that includes a radially outer surface and a radially inner surface, and a deflection plate that extends from the body. The deflection plate includes a radially outer surface and a radially inner surface that extends radially outward with respect to the centerline. The plate inner surface at least one of extends radially outward with respect to the centerline and defines a plurality of openings within the plate inner surface. The method further includes coupling the streamline flow conditioner to the case second end such that the streamline flow conditioner is coupled radially between the case and the combustor liner such that the deflection plate is adjacent the case second end.

A gas turbine combustor system is provided. The system includes a case comprising a first end, a second end, and a centerline extending there between. The system also includes an end cover coupled to the case first end, a combustor liner coupled within the case such that the liner is substantially coaxially aligned with respect to the case, and a streamline flow conditioner coupled between the case and the combustor liner. The streamline flow conditioner including a body comprising a radially outer surface, a radially inner surface opposite the outer surface, a first end, and a second end. The body first end is adjacent the end cover. The body second end is adjacent the case second end. The system also includes a deflection plate including a radially outer surface and a radially inner surface opposing the plate outer surface. The deflection plate extends from the body second end. The plate inner surface at least one of extends radially outward with respect to the centerline and defines a plurality of openings within the plate inner surface.

A streamline flow conditioner for a combustor is provided. The streamline flow conditioner includes a body including a radially outer surface, a radially inner surface opposite the outer surface, a first end, a second end, and a plurality of openings defined within the second end. The streamline flow conditioner also includes a deflection plate including a radially outer surface and a radially inner surface opposite the plate outer surface. The deflection plate extends from the body second end. The plate inner surface at least one of extends radially outward with respect to the centerline and defines a plurality of openings within the plate inner surface.

DETAILED DESCRIPTION OF THE INVENTION

The exemplary methods and systems described herein overcome the structural disadvantages of known flow sleeves by reconfiguring a portion of the streamline flow conditioner that is adjacent to an inlet area. Although the exemplary streamline flow conditioner designs are described herein with respect to gas turbine systems, it should be appreciated that the exemplary streamline flow conditioners are applicable to other combustion systems such as, but not limited to, natural gas and integrated gasification combined-cycle (IGCC) power generation systems. It should be appreciated that the terms "axial" and "axially" are used throughout this application to refer to directions and orientations extending generally parallel to a centerline of the associated turbine engine. It should be appreciated that "radial" and "radially" are used throughout this application to refer to directions and orientations extending substantially perpendicular to a centerline of the turbine engine.

Figure 1:
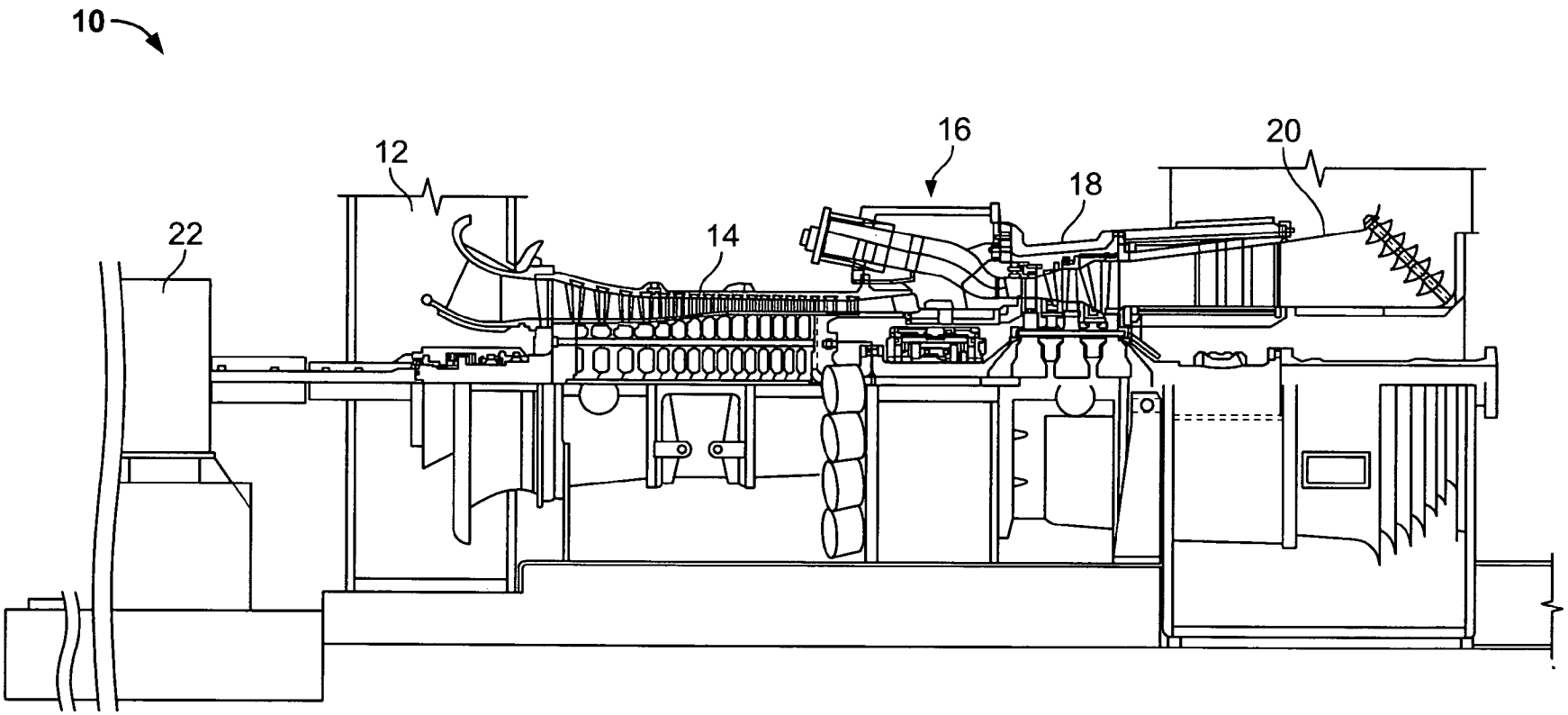
FIG. 1 is a schematic illustration of an exemplary gas turbine system including a combustion section.

FIG. 1 is a schematic illustration of an exemplary gas turbine system 10 including an intake section 12, a compressor section 14 coupled downstream from the intake section 12, a combustor section 16 coupled downstream from the intake section 12, a turbine section 18 coupled downstream from the combustor section 16, and an exhaust section 20. Turbine section 18 drives compressor section 14 and a load 22 such as, but not limited to, an electrical generator and a mechanical drive application.

During operation, intake section 12 channels inlet air to compressor section 14. The inlet air is compressed to higher pressures and temperatures, and the compressed air is channeled to combustor section 16. Combustor section 16 facilitates mixing and burning the compressed air and fuel to generate combustion gases that are discharged towards turbine section 18 to drive compressor section 14 and/or load 22. Exhaust gases exiting turbine section 18 flow through exhaust section 20 to ambient atmosphere.

Figure 2:
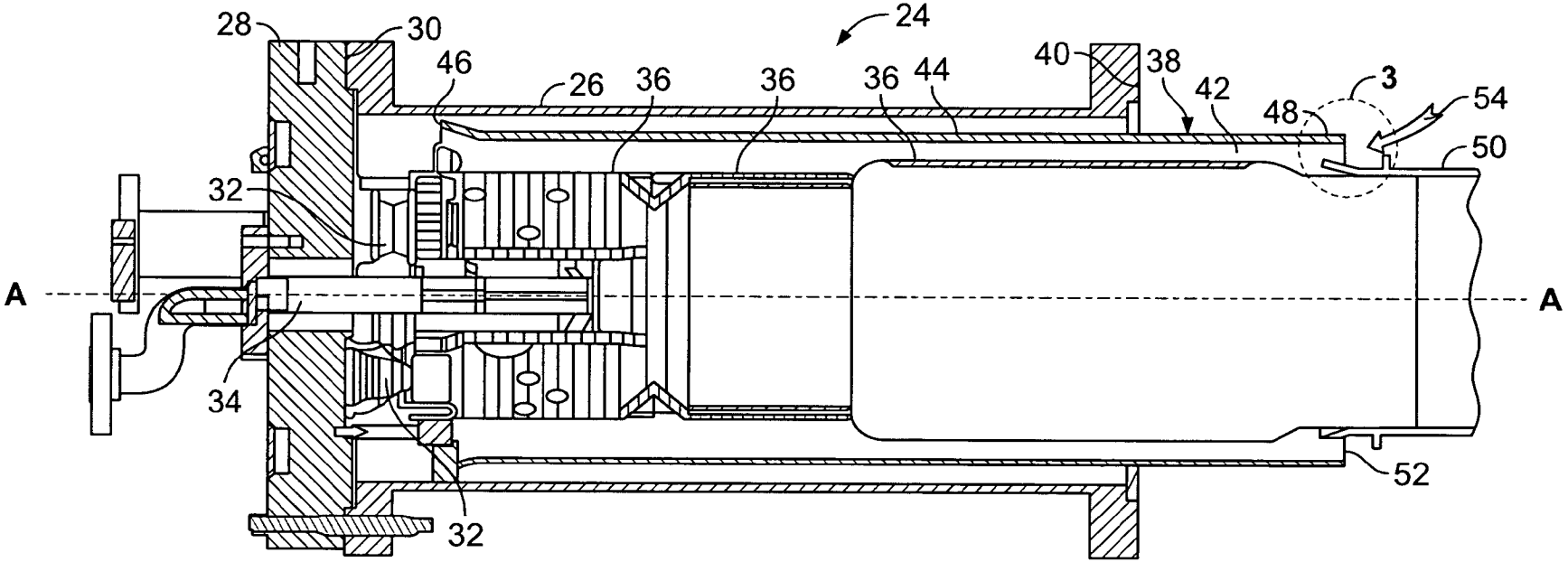
FIG. 2 (Prior Art)
FIG. 2 is a schematic cross-sectional view of a known combustor that may be used with the gas turbine system shown in FIG. 1.

FIG. 2 is a cross-sectional view of a known combustor 24 that may be used with gas turbine system 10 (shown in FIG. 1). In the exemplary embodiment, combustor 24 includes a centerline axis A-A, an annular case 26, and end cover 28 coupled to a first end 30 of case 26. A plurality of fuel nozzles 32 and an additional fuel nozzle 34 are coupled to end cover 28.

Combustor 24 also includes a combustion liner 36 and a streamline flow conditioner 38 that is coaxially coupled within case 26. In the exemplary embodiment, streamline flow conditioner 38 is coupled to a second end 40 of case 26 and is coupled radially between case 26 and combustion liner 36. More specifically, streamline flow conditioner 38 is spaced a radial distance from combustion liner 36 such that an air passage 42 is defined there between. Streamline flow conditioner 38 includes a body 44 including a first end 46 and an opposite second end 48. A transition piece 50 is coupled to an end of combustion liner 36 near second end 48 to facilitate channeling combustion gases towards turbine nozzles (not shown). A combination of combustion liner 36, streamline flow conditioner second end 48, and/or transition piece 50 define a streamline flow conditioner inlet 52.

During operation, a portion of compressed airflow 54 may enter passage 42 from a larger and/or higher pressure plenum (not shown) surrounding streamline flow conditioner inlet 52. As a result, within combustor 24, pressure losses may develop near streamline flow conditioner inlet 52. Additionally, other structural features near streamline flow conditioner inlet 52 may contribute to undesirable pressure losses in the compressed air flowing through passage 42.

Figure 3:
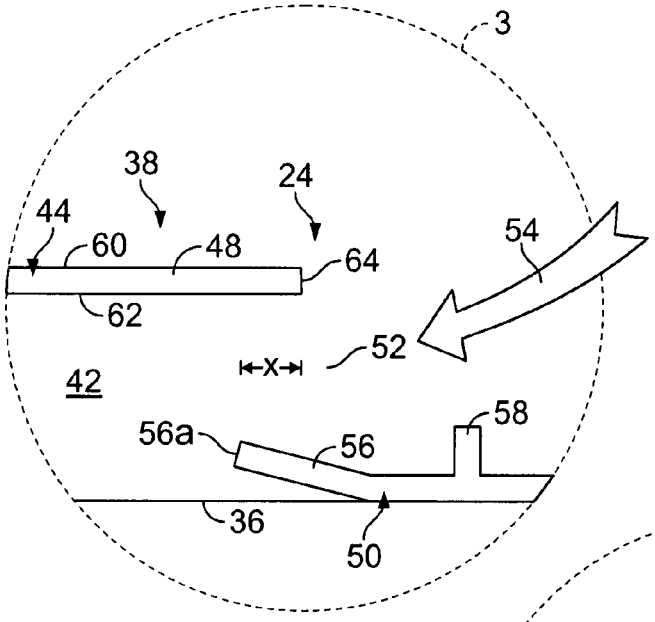
FIG. 3 (Prior Art)
FIG. 3 is an enlarged cross-sectional view of a portion of a flow sleeve of a known combustor shown in FIG. 2 and taken along area 3.

FIG. 3 is an enlarged cross-sectional view of a portion of streamline flow conditioner 38 of combustor 24 taken along area 3. In the exemplary embodiment, transition piece 50 and streamline flow conditioner body second end 48 may contribute to, or cause, undesirable pressure losses in air flowing through combustor 24. Specifically, transition piece 50 includes an annular bellmouth 56 and an annular support ring 58 that partially obstruct the compressed air entering passage 42 through streamline flow conditioner inlet 52 when transition piece is coupled to combustion liner 36.

In the exemplary embodiment, streamline flow conditioner body 44 includes a radially outer surface 60 and a radially inner surface 62 that are each substantially parallel to centerline axis A-A (shown in FIG. 2). Second end 48 also includes a sharp edge 64 that extends substantially perpendicularly to centerline axis A-A. In one embodiment, body edge 64 is axially spaced an axial distance X from an edge 56*a* of transition piece 50. Edge 64 partially obstructs compressed air entering passage 42 through streamline flow conditioner inlet 52 during operation. Alternatively, edge 64 is known to extend to a perforated inlet deflection plate (not shown) that extends radially inward from inner surface 62.

As a result of such obstructions, compressed air entering streamline flow conditioner 38 may experience undesirable pressure losses. For example, edge 64 is known to create high pressure losses near streamline flow conditioner inlet 52. Generally, known combustors such as combustor 24 are configured to operate with a predetermined pressure drop in compressed air such as, but not limited to, an approximate 4.5% pressure drop. As such, the remaining 3.5% pressure drop may be tolerated by other sections of combustor 24. In other words, the pressure losses resulting from edge 64 reduce the amount of air available for cooling combustion liner 36 and/or for mixing with fuel introduced by nozzles 32 coupled adjacent to first end 46 of streamline flow conditioner 38. As a result of the pressure drop adjacent the streamline flow conditioner inlet, an amount of pollutants generated such as, but not limited to, carbon monoxide (CO) and nitrogen oxides ($NO_x$) emissions may be undesirably increased. Further, hardware durability and efficiency may be negatively impacted.

Figure 4:
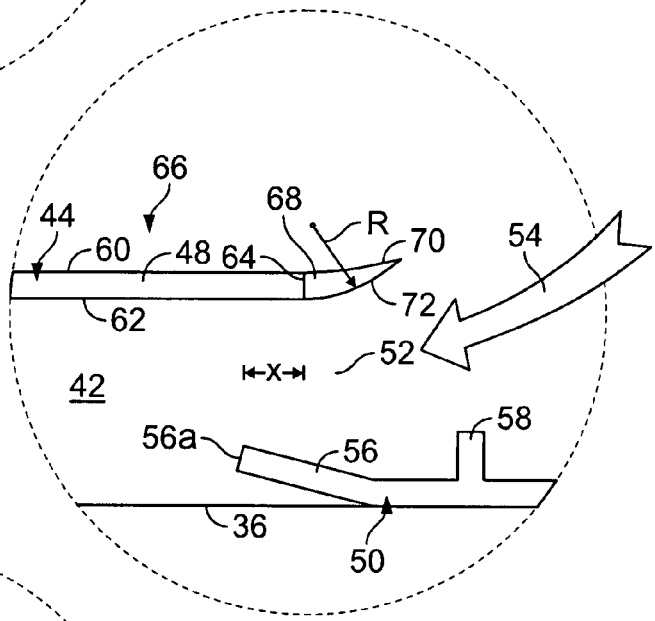
FIG. 4 is an enlarged cross-sectional view of an exemplary streamline flow conditioner deflection plate that may be used with the combustor shown in FIG. 2.

FIG. 4 is an enlarged cross-sectional view of an exemplary streamline flow conditioner 66 that may be used with combustor 24 (shown in FIG. 2). Streamline flow conditioner 66 is substantially similar to streamline flow conditioner 38 shown in FIGS. 2 and 3, and components in FIG. 4 that are identical to components of FIGS. 2 and 3, are identified in FIG. 4 using the same reference numerals used in FIGS. 2 and 3.

In the exemplary embodiment, streamline flow conditioner 66 includes a deflection plate 68 extending from second end edge 64. Deflection plate 68 includes an outer surface 70 that is oriented substantially parallel to a centerline axis A-A (shown in FIG. 2) of combustor 24. Deflection plate 68 also includes an arcuate fillet 72 that is radially inward of, and opposes outer surface 70. Fillet 72 is formed with a radius of curvature R and extends radially outward from body inner surface 62 to deflection plate outer surface 70. In one embodiment, fillet may include a non-circular cross-section. In one embodiment, deflection plate 68 may be coupled to streamline flow conditioner body 44. It should also be appreciated that deflection plate 68 may be formed with any shape such as, but not limited to, a curved shape that facilitates reducing a pressure drop at streamline flow conditioner inlet 52 as herein described. Further, it should be appreciated that radius R may be any radius that facilitates reducing a pressure drop at streamline flow conditioner inlet 52 as herein described.

Because inner fillet 72 extends radially outward from inner surface 62, deflection plate 68 provides a smoother transition for compressed airflow 54 directed into passage 42, as compared to known streamline flow conditioners. Because inner fillet 72 extends radially outward from inner surface 62, deflection plate 68 also provides a larger inlet opening, as compared to known streamline flow conditioners. As a result, streamline flow conditioner 66 facilitates reducing an amount of pressure drop adjacent streamline flow conditioner inlet 52 as compared to known streamline flow conditioners. As a result, an increased total pressure drop may be tolerated by other combustor components as compared to known combustors that include known streamline flow conditioners. Because inner fillet 72 extends radially outward from inner surface 62, deflection plate 68 also provides more airflow through streamline flow conditioner passage 42, as compared to known streamline flow conditioners. As a result, a larger amount of compressed air may be mixed with fuel for combustion, as compared to known streamline flow conditioners. As such, streamline flow conditioner 66 facilitates reducing the formation of air polluting emissions such as, but not limited to, CO and $NO_x$. In addition, excess air towards the combustor headend may facilitate damping to combustor thermo acoustics.

Figure 5:
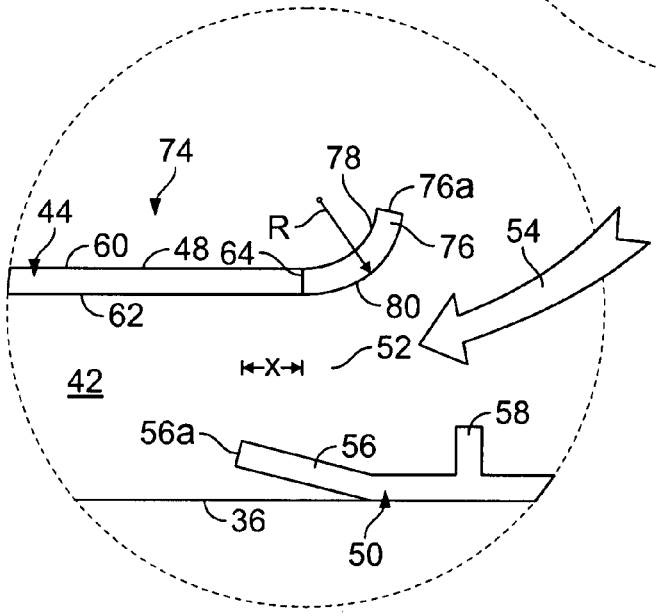
FIG. 5 is an enlarged cross-sectional view of an alternative streamline flow conditioner deflection plate that may be used with the combustor shown in FIG. 2.

FIG. 5 is an enlarged cross-sectional view of an exemplary streamline flow conditioner 74 that may be used with combustor 24 (shown in FIG. 2). Streamline flow conditioner 74 is substantially similar to streamline flow conditioners 38 and 66 shown in FIGS. 2-4 respectively, and components in FIG. 5 that are identical to components of FIGS. 2-4, are identified in FIG. 5 using the same reference numerals used in FIGS. 2-4.

In the exemplary embodiment, streamline flow conditioner 74 includes a conical deflection plate 76 extending from second end edge 64. Deflection plate 76 includes an outer surface 78 that is oriented substantially parallel to a radially inner surface 80 opposing outer surface 78. Deflection plate 76 includes a free end edge 76*a* that connects outer surface 78 and inner surface 80. Deflection plate 76 is formed with a radius of curvature R and extends radially outward from body inner surface 62 to end edge 76*a*. In one embodiment, deflection plate 76 may be coupled to streamline flow conditioner body 44. It should be appreciated that deflection plate 76 may be formed with any shape that facilitates reducing a pressure drop at streamline flow conditioner inlet 52 as herein described. Further, it should be appreciated that radius R may be any radius that facilitates reducing a pressure drop at streamline flow conditioner inlet 52 as herein described.

Because inner surface 80 extends radially outward from inner surface 62, deflection plate 76 provides a smoother transition for compressed airflow 54 directed into passage 42 as compared to known streamline flow conditioners. Because inner surface 80 extends radially outward from inner surface 62, deflection plate 76 also provides a larger inlet opening, as compared to known streamline flow conditioners. As a result, streamline flow conditioner 74 facilitates reducing an amount of pressure drop adjacent streamline flow conditioner inlet 52 as compared to known streamline flow conditioners. As a result, an increased total pressure drop may be tolerated by other combustor components, as compared to known combustors that include streamline flow conditioners. Because inner surface 80 extends radially outward from inner surface 62, deflection plate 76 further provides more airflow through streamline flow conditioner passage 42, as compared to known streamline flow conditioners. As a result, a larger amount of compressed air may be mixed with fuel for combustion, as compared to known streamline flow conditioners. As such, streamline flow conditioner 74 facilitates reducing the formation of air polluting emissions such as, but not limited to, nitrogen oxides ("$NO_x$").

Figure 6:
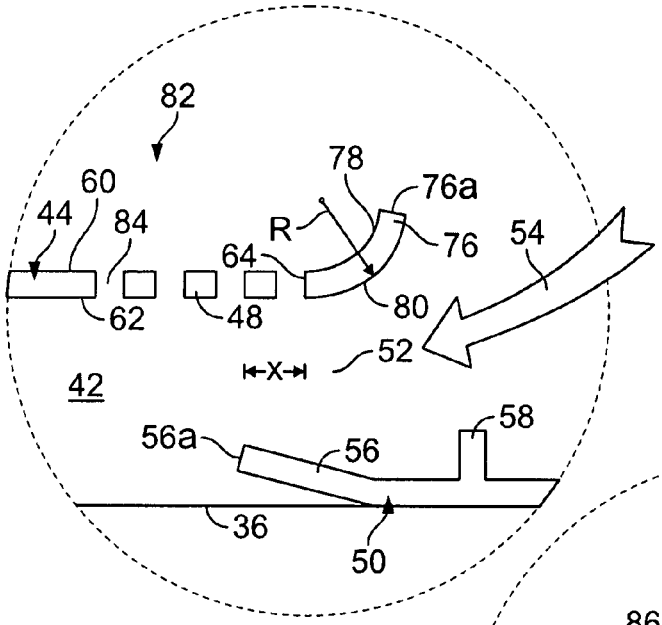
FIG. 6 is an enlarged cross-sectional view of another alternative streamline flow conditioner deflection plate that may be used with the combustor shown in FIG. 2.

FIG. 6 is an enlarged cross-sectional view of an exemplary streamline flow conditioner 82 that may be used with combustor 24 (shown in FIG. 2). Streamline flow conditioner 82 is substantially similar to streamline flow conditioners 38, 66, and 74 shown in FIGS. 2-5 respectively, and components in FIG. 6 that are identical to components of FIGS. 2-5, are identified in FIG. 6 using the same reference numerals used in FIGS. 2-5.

In the exemplary embodiment, streamline flow conditioner 82 includes conical deflection plate 76 extending from second end edge 64. Deflection plate 76 includes outer surface 78 and radially inner surface 80. Streamline flow conditioner 82 also includes a plurality of openings 84 defined between outer and inner surfaces 60 and 62 of streamline flow conditioner body 44.

Because inner surface 80 extends radially outward from inner surface 62, deflection plate 76 provides a smoother transition for compressed airflow 54 directed into passage 42 as compared to known streamline flow conditioners. Because second end 48 includes openings 84, streamline flow conditioner 82 provides additional inlets of compressed airflow into passage 42, as compared to known streamline flow conditioners. Because inner surface 80 extends radially outward from inner surface 62, deflection plate 76 also provides a larger inlet opening, as compared to known streamline flow conditioners. As a result, streamline flow conditioner 82 facilitates reducing an amount of pressure drop adjacent streamline flow conditioner inlet 52 as compared to known streamline flow conditioners. As a result, an increased total pressure drop may be tolerated by other combustor components, as compared to known combustors that include streamline flow conditioners. Because inner surface 80 extends radially outward from inner surface 62, deflection plate 76 further provides more airflow through streamline flow conditioner passage 42, as compared to known streamline flow conditioners. As a result, a larger amount of compressed air may be mixed with fuel for combustion, as compared to known streamline flow conditioners. As such, streamline flow conditioner 82 facilitates reducing the formation of air polluting emissions such as, but not limited to, $NO_x$.

Figure 7:
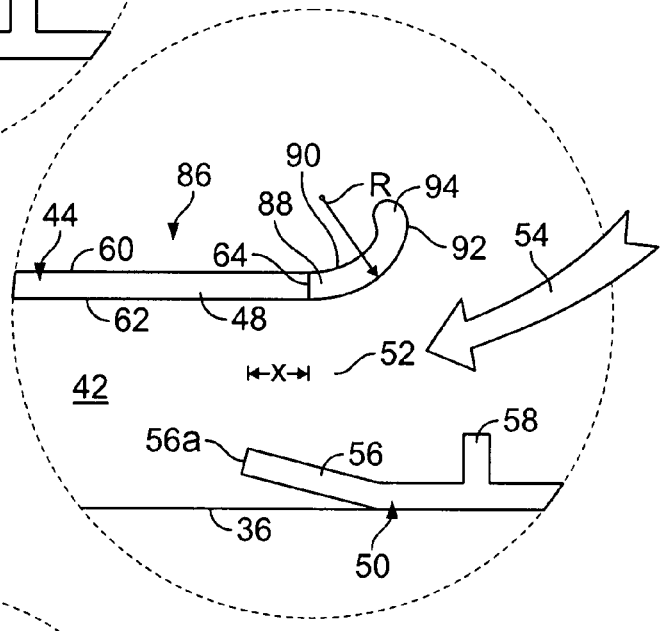
FIG. 7 is an enlarged cross-sectional view of a further alternative streamline flow conditioner deflection plate that may be used with the combustor shown in FIG. 2.

FIG. 7 is an enlarged cross-sectional view of an exemplary streamline flow conditioner 86 that may be used with combustor 24 (shown in FIG. 2). Streamline flow conditioner 86 is substantially similar to streamline flow conditioners 38, 66, 74, and 82 shown in FIGS. 2-6 respectively, and components in FIG. 7 that are identical to components of FIGS. 2-6, are identified in FIG. 7 using the same reference numerals used in FIGS. 2-6.

In the exemplary embodiment, streamline flow conditioner 86 includes a deflection plate 88 extending from second end edge 64. Deflection plate 88 includes an outer surface 90, a radially inner surface 92 opposing outer surface 90, and an end portion 94 that connects outer surface 90 and inner surface 92. Inner surface 92 includes a radius of curvature R and extends radially outward from body inner surface 62 to end portion 94. End portion 94 has a substantially circular cross-section. In one embodiment, end portion may include a non-circular cross-section. In one embodiment, deflection plate 88 may be coupled to streamline flow conditioner body 44. It should be appreciated that deflection plate 88 may be formed with any shape that facilitates reducing a pressure drop at streamline flow conditioner inlet 52 as herein described. Further, it should be appreciated that radius R may be any radius that facilitates reducing a pressure drop at streamline flow conditioner inlet 52 as herein described.

Because inner surface 92 extends radially outward from inner surface 62, deflection plate 88 provides a smoother transition for compressed airflow directed 54 into passage 42 as compared to known streamline flow conditioners. Because deflection plate 88 also includes end 94, deflection plate 88 provides a smoother transition for compressed airflow 54 directed into passage 42 as compared to known streamline flow conditioners. Because inner surface 92 extends radially outward from inner surface 62, deflection plate 88 also provides a larger inlet opening, as compared to known streamline flow conditioners. As a result, streamline flow conditioner 86 facilitates reducing an amount of pressure drop adjacent streamline flow conditioner inlet 52 as compared to known streamline flow conditioners. As a result, an increased total pressure drop may be tolerated by other combustor components, as compared to known combustors that include streamline flow conditioners. Because inner surface 92 extends radially outward from inner surface 62, deflection plate 88 further provides more airflow through streamline flow conditioner passage 42, as compared to known streamline flow conditioners. As a result, a larger amount of compressed air may be mixed with fuel for combustion, as compared to known streamline flow conditioners. As such, streamline flow conditioner 86 facilitates reducing the formation of air polluting emissions such as, but not limited to, $NO_x$.

Figure 8:
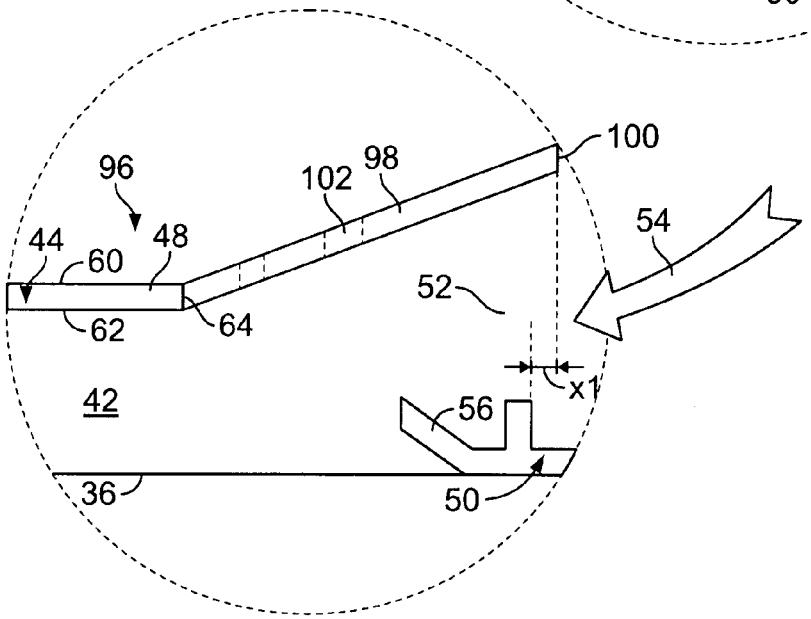
FIG. 8 is an enlarged cross-sectional view of a further alternative streamline flow conditioner deflection plate that may be used with the combustor shown in FIG. 2.

FIG. 8 is an enlarged cross-sectional view of an exemplary streamline flow conditioner 96 that may be used with combustor 24 (shown in FIG. 2). Streamline flow conditioner 96 is substantially similar to streamline flow conditioners 38, 66, 74, 82, and 82 shown in FIGS. 2-7 respectively, and components in FIG. 8 that are identical to components of FIGS. 2-7, are identified in FIG. 8 using the same reference numerals used in FIGS. 2-7.

In the exemplary embodiment, streamline flow conditioner 96 includes a conical deflection plate 98 extending from second end edge 64. Deflection plate 98 extends radially outward from body inner surface 62 to an end edge 100. Deflection plate 98 also extends an axial distance $X_1$ from support ring 58 of transition piece 50 to overlap support ring 58 and additional portions of transition piece 50. Further, deflection plate 98 includes a plurality of openings 102. In one embodiment, deflection plate 98 may be coupled to streamline flow conditioner body 44. It should be appreciated that deflection plate 98 may be formed with any shape that facilitates reducing a pressure drop at streamline flow conditioner inlet 52 as herein described. Further, it should be appreciated that axial distance $X_1$ may be any axial distance that facilitates reducing a pressure drop at streamline flow conditioner inlet 52 as herein described.

Because deflection plate 98 extends radially outward from inner surface 62, deflection plate 98 provides a smoother transition for compressed airflow 54 directed into passage 42 as compared to known streamline flow conditioners. Because deflection plate 98 includes openings 102, streamline flow conditioner 96 provides additional inlets of compressed airflow into passage 42, as compared to known streamline flow conditioners. Because deflection plate 98 extends radially outward from inner surface 62, deflection plate 98 also provides a larger inlet opening as compared to known streamline flow conditioners. Because deflection plate 98 extends axially from support ring 58 of transition piece 50 to overlap support ring 58 and additional portions of transition piece 50, inlet 52 is further extended and/or enlarged as compared to known streamline flow conditioners. Because deflection plate 98 extends axially from support ring 58 of transition piece 50 to overlap support ring 58 and additional portions of transition piece 50, inlet 52 is further extended to facilitate increasing the flow area as compared to known streamline flow conditioners.

As a result, streamline flow conditioner 96 facilitates reducing the effects of airflow disturbances, which may be caused by bellmouth 56 and/or support ring 58 on the overall airflow in passage 42. As a result, streamline flow conditioner 96 facilitates reducing an amount of pressure drop adjacent streamline flow conditioner inlet 52 as compared to known streamline flow conditioners. As a result, an increased total pressure drop may be tolerated by other combustor components, as compared to known combustors that include streamline flow conditioners. Because deflection plate 98 extends radially outward from inner surface 62, deflection plate 98 further provides more airflow through streamline flow conditioner passage 42, as compared to known streamline flow conditioners. As a result, a larger amount of compressed air may be mixed with fuel for combustion, as compared to known streamline flow conditioners. As such, streamline flow conditioner 96 facilitates reducing the formation of air polluting emissions such as, but not limited to, $NO_x$.

Figure 9:
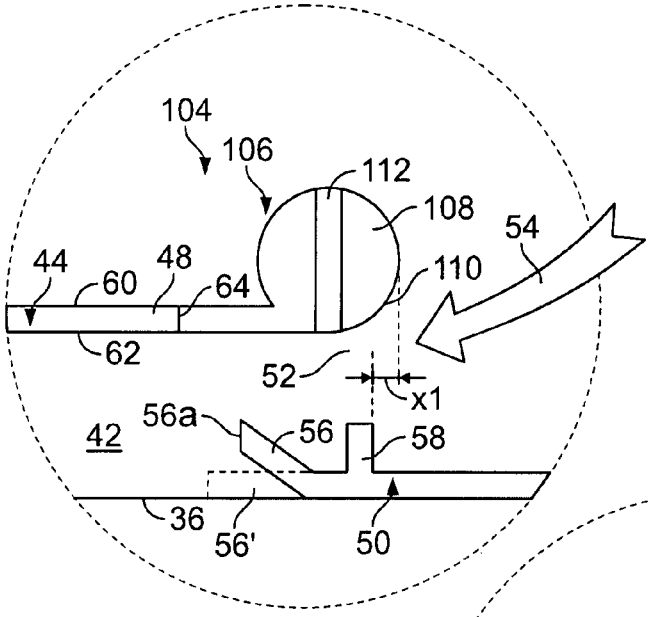
FIG. 9 is an enlarged cross-sectional view of another alternative streamline flow conditioner deflection plate that may be used with the combustor shown in FIG. 2.

FIG. 9 is an enlarged cross-sectional view of an exemplary streamline flow conditioner 104 that may be used with combustor 24 (shown in FIG. 2). Streamline flow conditioner 104 is substantially similar to streamline flow conditioners 38, 66, 74, 82, and 96 shown in FIGS. 2-8 respectively, and components in FIG. 9 that are identical to components of FIGS. 2-8, are identified in FIG. 9 using the same reference numerals used in FIGS. 2-8.

In the exemplary embodiment, streamline flow conditioner 104 includes a deflection plate 106 extending from second end edge 64. Deflection plate 106 includes an end portion 108 that has a rounded inner surface 110 and a substantially circular cross-section. In one embodiment, end portion may include a non-circular cross-section. End portion inner surface 110 extends radially outward from body inner surface 62 and extends an axial distance $X_1$ from support ring 58 of transition piece 50 to overlap support ring 58 and additional portions of transition piece 50 and/or a transition piece seal 56' that couples transition piece 50 to combustion liner. Further, end portion 108 includes one or more openings 112. In one embodiment, deflection plate 106 may be coupled to streamline flow conditioner body 44. It should be appreciated that deflection plate 106 may be formed with any shape that facilitates reducing a pressure drop at streamline flow conditioner inlet 52 as herein described. Further, it should be appreciated that axial distance $X_1$ may be any axial distance that facilitates reducing a pressure drop at streamline flow conditioner inlet 52 as herein described.

Because end portion inner surface 110 extends radially outward from inner surface 62, deflection plate 106 provides a smoother transition for compressed airflow 54 directed into passage 42 as compared to known streamline flow conditioners. Because deflection plate 106 includes openings 112, streamline flow conditioner 104 provides additional inlets of compressed airflow into passage 42, as compared to known streamline flow conditioners. Because inner surface 110 extends radially outward from inner surface 62, deflection plate 106 also provides a larger inlet opening as compared to known streamline flow conditioners. Because deflection plate 106 extends axially from support ring 58 of transition piece 50 to overlap support ring 58 and additional portions of transition piece 50, inlet 52 is further extended and/or enlarged as compared to known streamline flow conditioners. Because deflection plate 106 extends axially from support ring 58 of transition piece 50 to overlap support ring 58 and additional portions of transition piece 50, inlet 52 is further extended to facilitate increasing the flow area as compared to known streamline flow conditioners.

As a result, streamline flow conditioner 104 facilitates reducing the effects of airflow disturbances, which may be caused by bellmouth 56, transition piece seal 56', and/or support ring 58 on the overall airflow in passage 42. As a result, streamline flow conditioner 104 facilitates reducing an amount of pressure drop adjacent streamline flow conditioner inlet 52 as compared to known streamline flow conditioners. As a result, an increased total pressure drop may be tolerated by other combustor components, as compared to known combustors that include streamline flow conditioners. Because inner surface 110 extends radially outward from inner surface 62, deflection plate 106 further provides more airflow through streamline flow conditioner passage 42, as compared to known streamline flow conditioners. As a result, a larger amount of compressed air may be mixed with fuel for combustion, as compared to known streamline flow conditioners. As such, streamline flow conditioner 104 facilitates reducing the formation of air polluting emissions such as, but not limited to, $NO_x$.

Figure 10:
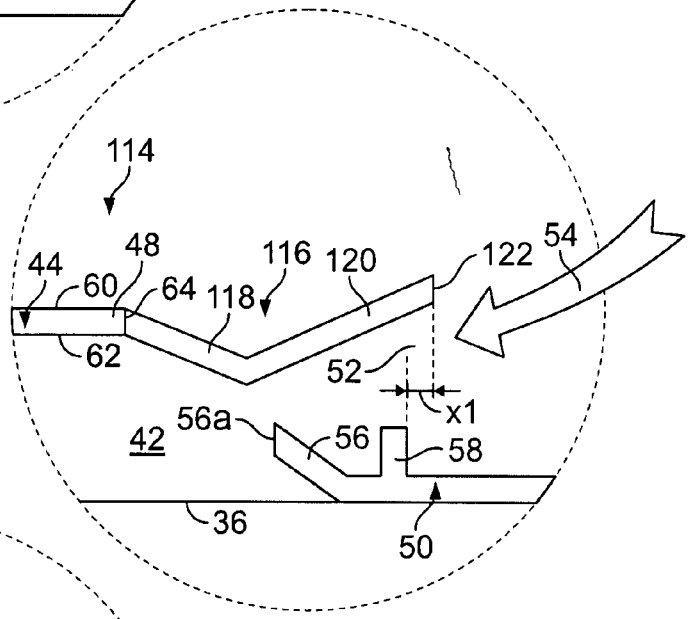
FIG. 10 is an enlarged cross-sectional view of a yet another further alternative streamline flow conditioner deflection plate that may be used with the combustor shown in FIG. 2.

FIG. 10 is an enlarged cross-sectional view of an exemplary streamline flow conditioner 114 that may be used with combustor 24 (shown in FIG. 2). Streamline flow conditioner 114 is substantially similar to streamline flow conditioners 38, 66, 74, 82, 82, 96, and 104 shown in FIGS. 2-9 respectively, and components in FIG. 10 that are identical to components of FIGS. 2-9, are identified in FIG. 10 using the same reference numerals used in FIGS. 2-9.

In the exemplary embodiment, streamline flow conditioner 114 includes a conical deflection plate 116 extending from second end edge 64. Deflection plate 116 includes a converging portion 118 and a diverging portion 120 that respectively extend radially inward and outward from body inner surface 62 to an end edge 122. Deflection plate 116 also extends an axial distance $X_1$ from support ring 58 of transition piece 50 to overlap support ring 58 and additional portions of transition piece 50. In one embodiment, deflection plate 116 may be coupled to streamline flow conditioner body 44. It should be appreciated that deflection plate 116 may be formed with any shape that facilitates reducing a pressure drop at streamline flow conditioner inlet 52 as herein described. Further, it should be appreciated that axial distance $X_1$ may be any axial distance that facilitates reducing a pressure drop at streamline flow conditioner inlet 52 as herein described.

Because deflection plate 116 includes converging portion 118, control of airflow within passage 42 may be facilitated. Because deflection plate diverging portion 120 extends radially outward from inner surface 62, deflection plate 116 provides a smoother transition for compressed airflow 54 directed into passage 42 as compared to known streamline flow conditioners. Because deflection plate 116 extends radially outward from inner surface 62, deflection plate 116 also provides a larger inlet opening as compared to known streamline flow conditioners. Because deflection plate 116 extends axially from support ring 58 of transition piece 50 to overlap support ring 58 and additional portions of transition piece 50, inlet 52 is further extended and/or enlarged as compared to known streamline flow conditioners. Because deflection plate 116 extends axially from support ring 58 of transition piece 50 to overlap support ring 58 and additional portions of transition piece 50, inlet 52 is further extended to facilitate increasing the flow area as compared to known streamline flow conditioners.

As a result, streamline flow conditioner 114 facilitates reducing the effects of airflow disturbances, which may be caused by bellmouth 56 and/or support ring 58 on the overall airflow in passage 42. As a result, streamline flow conditioner 114 facilitates reducing an amount of pressure drop adjacent streamline flow conditioner inlet 52 as compared to known streamline flow conditioners. As a result, an increased total pressure drop may be tolerated by other combustor components, as compared to known combustors that include streamline flow conditioners. Because deflection plate 116 extends radially outward from inner surface 62, deflection plate 116 further provides more airflow through streamline flow conditioner passage 42, as compared to known streamline flow conditioners. As a result, a larger amount of compressed air may be mixed with fuel for combustion, as compared to known streamline flow conditioners. As such, streamline flow conditioner 114 facilitates reducing the formation of air polluting emissions such as, but not limited to, $NO_x$.

Figure 11:
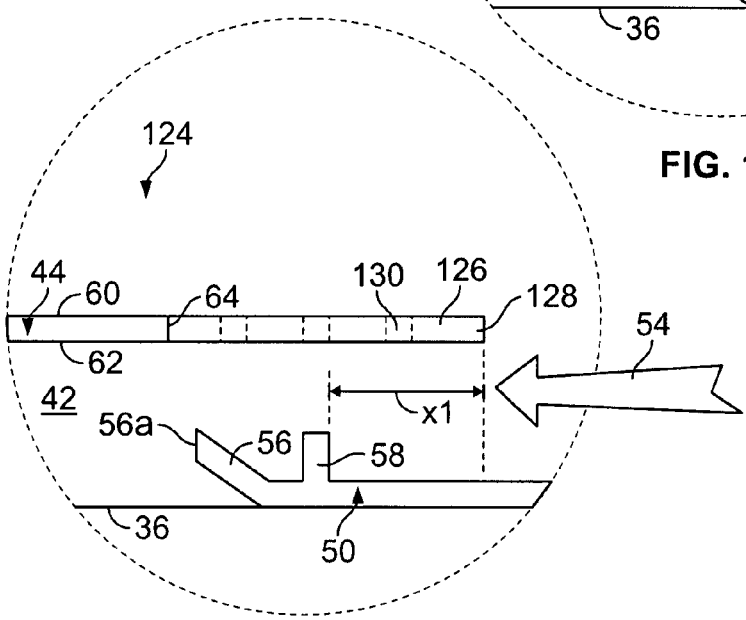
FIG. 11 is an enlarged cross-sectional view of a further alternative streamline flow conditioner deflection plate that may be used with the combustor shown in FIG. 2.

FIG. 11 is an enlarged cross-sectional view of an exemplary streamline flow conditioner 124 that may be used with combustor 24 (shown in FIG. 2). Streamline flow conditioner 124 is substantially similar to streamline flow conditioners 38, 66, 74, 82, 82, 96, 104, and 114 shown in FIGS. 2-10 respectively, and components in FIG. 11 that are identical to components of FIGS. 2-10, are identified in FIG. 11 using the same reference numerals used in FIGS. 2-10.

In the exemplary embodiment, streamline flow conditioner 124 includes a deflection plate 126 extending from second end edge 64. Deflection plate 126 includes an end edge 128 that extends an axial distance $X_1$ from support ring 58 of transition piece 50 to overlap support ring 58 and additional portions of transition piece 50. Further, deflection plate 126 includes one or more openings 130. In one embodiment, deflection plate 126 may be coupled to streamline flow conditioner body 44. It should be appreciated that deflection plate 126 may be formed with any shape that facilitates reducing a pressure drop at streamline flow conditioner inlet 52 as herein described. Further, it should be appreciated that axial distance $X_1$ may be any axial distance that facilitates reducing a pressure drop at streamline flow conditioner inlet 52 as herein described.

Because deflection plate 126 includes openings 130, streamline flow conditioner 124 provides additional inlets of compressed airflow into passage 42, as compared to known streamline flow conditioners. Because deflection plate 126 extends axially from support ring 58 of transition piece 50 to overlap support ring 58 and additional portions of transition piece 50, inlet 52 is further extended to facilitate increasing the flow area as compared to known streamline flow conditioners. As a result, streamline flow conditioner 124 facilitates reducing the effects of airflow disturbances, which may be caused by bellmouth 56 and/or support ring 58 on the overall airflow in passage 42. As a result, streamline flow conditioner 124 facilitates reducing the effects of airflow disturbances, which may be caused by support ring 58 and/or bellmouth 56, on the overall airflow in passage 42. As a result, streamline flow conditioner 124 facilitates reducing an amount of pressure drop adjacent streamline flow conditioner inlet 52 as compared to known streamline flow conditioners. As a result, an increased total pressure drop may be tolerated by other combustor components, as compared to known combustors that include streamline flow conditioners. As a result, a larger amount of compressed air may be mixed with fuel for combustion, as compared to known streamline flow conditioners. As such, streamline flow conditioner 124 facilitates reducing the formation of air polluting emissions such as, but not limited to, NOx.

A method for assembling combustor 24 is provided. The method includes providing combustor case 26 having first end 30, second end 40, and a centerline A-A extending there between. The method also includes coupling end cover 28 to case first end 30 and coupling combustor liner 36 within case 26 such that liner 36 is substantially coaxially aligned with respect to case 26. The method also includes providing streamline flow conditioner 66, 74, 82, or 86 including body 44 that includes radially outer surface 60 and radially inner surface 62, and deflection plate 68, 76, or 86 that extends from body 44. Deflection plate 68, 76, or 86 includes radially outer surface 70, 78, or 90 and radially inner surface 72, 80, or 92 that extends radially outward with respect to centerline A-A. The method further includes coupling streamline flow conditioner 66, 74, 82, or 86 to case second end 40 such that streamline flow conditioner 66, 74, 82, or 86 is coupled radially between case 26 and combustor liner 36 such that deflection plate 68, 76, or 86 is adjacent case second end 40. Further, it should be appreciated that the above-described exemplary streamline flow conditioner may be incorporated during combustion inspection intervals.

In the above embodiments, it should be appreciated that radius R and/or axial distance X of the deflection plates from the transition piece may be varied to facilitate reducing pressure drops near streamline flow conditioner inlets. For example, it should be appreciated that a larger radius R and a larger axial distance facilitates reducing the pressure drop at streamline flow conditioner inlets as compared to smaller a radius R and a smaller axial distance. Further, it should be appreciated that any of the exemplary deflections plates may be coupled to or be formed integrally with any of the exemplary streamline flow conditioner bodies.

As described herein, each streamline flow conditioner includes a deflection plate that extends radially outward with respect to an inner surface of a streamline flow conditioner body. As a result, a smoother inlet area is defined as compared to known streamline flow conditioners. The exemplary streamline flow conditioner designs facilitate reducing pressure losses near the streamline flow conditioner inlets such that an increased total pressure drop may be tolerated by other combustor components, as compared to known combustors that include streamline flow conditioners. As a result, the exemplary streamline flow conditioner designs facilitate reducing pressure losses near the streamline flow conditioner inlet that were experienced by known streamline flow conditioners. Further, the exemplary streamline flow conditioners enable a larger amount of compressed air to mix with fuel. As such, streamline flow conditioner facilitates lowering emissions as compared to known streamline flow conditioners.

Exemplary embodiments of streamline flow conditioners are described in detail above. The streamline flow conditioners are not limited to use with the specified combustors and turbine containing systems described herein, but rather, the streamline flow conditioners can be utilized independently and separately from other combustor and/or turbine containing system components described herein. Moreover, the invention is not limited to the embodiments of the combustors described in detail above. Rather, other variations of streamline flow conditioner embodiments may be utilized within the spirit and scope of the claims.

While the invention has been described in terms of various specific embodiments, those skilled in the art will recognize that the invention can be practiced with modification within the spirit and scope of the claims.

What is claimed is:

1. A method for assembling a gas turbine combustor, said method comprising:

providing a combustor case having a first end, a second end, and a centerline extending there between;

coupling an end cover to the case first end;

coupling a combustor liner within the case such that the liner is substantially coaxially aligned with respect to the case;

coupling the combustor liner to a transition piece;

providing a streamline flow conditioner including a body that includes a radially outer surface and a radially inner surface, and a deflection plate that extends from the body, wherein the deflection plate includes a radially outer surface and a radially inner surface; and coupling the streamline flow conditioner to the case second end such that the streamline flow conditioner is coupled radially between the case and the combustor liner such that the deflection plate is adjacent the case second end, and such that the deflection plate inner surface at least one of extends radially outward with respect to the centerline and defines a plurality of openings within the deflection plate inner surface radially outward from the transition piece.

2. A method in accordance with claim 1 wherein coupling the streamline flow conditioner to the case second end comprises coupling the streamline flow conditioner to the case second end such that the streamline flow conditioner is substantially coaxially aligned with respect to the case.

3. A method in accordance with claim 1 wherein providing a streamline flow conditioner comprises providing a streamline flow conditioner wherein the deflection plate outer surface is oriented substantially parallel to the body inner surface.

4. A method in accordance with claim 1 wherein providing a streamline flow conditioner comprises providing a streamline flow conditioner wherein the deflection plate outer surface extends radially outward from the body outer surface.

5. A method in accordance with claim 1 wherein providing a streamline flow conditioner comprises providing a streamline flow conditioner wherein the deflection plate includes an end portion that has a substantially circular cross-section.

6. A method in accordance with claim 1 wherein providing a streamline flow conditioner comprises defining a plurality of openings within the streamline flow conditioner body, wherein the openings extend between the body inner surface and the body outer surface.

7. A method in accordance with claim 1 wherein providing a streamline flow conditioner comprises providing a streamline flow conditioner wherein the deflection plate that has a substantially conical shape.

8. A method in accordance with claim 1 wherein providing a streamline flow conditioner comprises providing a streamline flow conditioner body that has a substantially cylindrical shape.

9. A combustor system comprising:

a case comprising a first end, a second end, and a centerline extending there between;

an end cover coupled to said case first end;

a combustor liner coupled within said case such that said liner is substantially coaxially aligned with respect to the case;

a transition piece coupled to said combustor liner; and a streamline flow conditioner coupled between said case and said combustor liner, said streamline flow conditioner comprises:

a body comprising a radially outer surface, a radially inner surface opposite said outer surface, a first end, and a second end, said body first end adjacent said end cover, said body second end adjacent said case second end; and a deflection plate comprising a radially outer surface and a radially inner surface opposing said plate outer surface, said deflection plate extending from said body second end, said plate inner surface at least one of extending radially outward with respect to said centerline and defining a plurality of openings within said plate inner surface radially outward from said transition piece.

10. A combustor system in accordance with claim 9 wherein said plate outer surface is substantially parallel to said body inner surface.

11. A combustor system in accordance with claim 9 wherein said plate inner surface is arcuate.

12. A combustor system in accordance with claim 9 wherein said plate outer surface extends radially outward from said body outer surface.

13. A combustor system in accordance with claim 9 wherein said plate includes an end portion that has a substantially circular cross-section.

14. A combustor system in accordance with claim 9 wherein said body second end comprises a plurality of openings extending between said body inner surface and said body outer surface.

15. A combustor system in accordance with claim 9 wherein said deflection plate comprises a substantially conical shape.

16. A combustor system in accordance with claim 9 wherein said first portion comprises a substantially cylindrical shape.

17. A streamline flow conditioner for a combustor that includes a combustor liner coupled to a transition piece, said streamline flow conditioner comprising:

a body comprising a radially outer surface, a radially inner surface opposite said outer surface, a first end, a second end, and a plurality of openings defined within said second end; and a deflection plate comprising a radially outer surface, a radially inner surface opposite said plate outer surface, said deflection plate extending from said body second end, said plate inner surface at least one of extending radially outward from a centerline of the combustor and defining a plurality of openings within said plate inner surface radially outward from the transition piece when said streamline flow conditioner is coupled to the combustor.

18. A streamline flow conditioner in accordance with claim 17 wherein said plate outer surface is substantially parallel to said body inner surface.

19. A streamline flow conditioner in accordance with claim 17 wherein said plate outer surface extends radially outward from said body outer surface.

20. A streamline flow conditioner in accordance with claim 17 wherein said deflection plate includes a substantially rounded tip.

* * * * *